US010649479B2

(12) United States Patent
Heo et al.

(10) Patent No.: US 10,649,479 B2
(45) Date of Patent: May 12, 2020

(54) REGULATOR AND METHOD OF OPERATING REGULATOR

(71) Applicants: Donghun Heo, Hwaseong-si (KR); Tae-Hwang Kong, Suwon-si (KR); Yongjin Lee, Goyang-si (KR)

(72) Inventors: Donghun Heo, Hwaseong-si (KR); Tae-Hwang Kong, Suwon-si (KR); Yongjin Lee, Goyang-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 0 days.

(21) Appl. No.: 16/149,063

(22) Filed: Oct. 1, 2018

(65) Prior Publication Data

US 2019/0212762 A1 Jul. 11, 2019

(30) Foreign Application Priority Data

Jan. 9, 2018 (KR) ..... 10-2018-0002871

(51) Int. Cl.
*G05F 1/59* (2006.01)
*G05F 1/575* (2006.01)

(52) U.S. Cl.
CPC ..... *G05F 1/59* (2013.01); *G05F 1/575* (2013.01)

(58) Field of Classification Search
CPC ..... G05F 3/02; G05F 3/30; G05F 3/22; G05F 3/222; G05F 3/242; G05F 3/225; G05F 3/245; G05F 3/20; G05F 3/00; G05F 3/08; G05F 3/10; G05F 3/16; G05F 3/18; G05F 3/185; G05F 3/227; G05F 3/247; G05F 3/26; G05F 3/265; G05F 3/24; G05F 3/262
See application file for complete search history.

(56) References Cited

U.S. PATENT DOCUMENTS

| | | | | |
|---|---|---|---|---|
| 7,167,054 | B1 | 1/2007 | Dening et al. | |
| 7,554,310 | B2 | 6/2009 | Chapuis et al. | |
| 8,536,844 | B1 | 9/2013 | Kumar et al. | |
| 9,122,292 | B2 | 9/2015 | Pan et al. | |
| 9,417,643 | B2 | 8/2016 | Saint-Laurent et al. | |
| 9,734,904 | B1 | 8/2017 | Cho et al. | |
| 2006/0290547 | A1* | 12/2006 | Hazucha | G05F 1/56 341/119 |
| 2009/0278515 | A1* | 11/2009 | Broussard | G05F 1/577 323/267 |

(Continued)

FOREIGN PATENT DOCUMENTS

KR 10-1768064 B1 3/2017

*Primary Examiner* — Bryan R Perez
(74) *Attorney, Agent, or Firm* — Volentine, Whitt & Francos, PLLC

(57) ABSTRACT

A regulator includes a first resistor and a second resistor that are connected between a ground node and an output node, an amplifier that outputs an amplification voltage by comparing a reference voltage to a feedback voltage between the first resistor and the second resistor, and amplifying a difference between the reference voltage and the feedback voltage, an analog-to-digital converter that converts the amplification voltage to a digital code, and a plurality of transistors that are connected between a power node supplied with a power supply voltage and the output node and which adjusts a current being supplied to the output node in response to the digital code.

19 Claims, 9 Drawing Sheets

(56) References Cited

U.S. PATENT DOCUMENTS

| | | | | |
|---|---|---|---|---|
| 2015/0097545 | A1* | 4/2015 | Kommaraju | G05F 1/12 323/293 |
| 2016/0098050 | A1* | 4/2016 | Enjalbert | G05F 1/56 323/280 |
| 2016/0202715 | A1* | 7/2016 | Petrov | G05F 1/56 323/280 |
| 2017/0063231 | A1* | 3/2017 | Wang | H03M 1/12 |
| 2017/0212540 | A1 | 7/2017 | Cho et al. | |
| 2017/0242449 | A1* | 8/2017 | Chen | G05F 1/575 |
| 2018/0284823 | A1* | 10/2018 | Na | G05F 1/575 |
| 2018/0329440 | A1* | 11/2018 | Jefremow | G05F 1/563 |

* cited by examiner

REGULATOR AND METHOD OF OPERATING REGULATOR

CROSS-REFERENCE TO RELATED APPLICATIONS

This application claims priority under 35 U.S.C. § 119 to Korean Patent Application No. 10-2018-0002871 filed on Jan. 9, 2018, in the Korean Intellectual Property Office, the disclosures of which are incorporated by reference herein in their entireties.

BACKGROUND

Embodiments of the inventive concept described herein relate to an electronic device, and more particularly, relate to a regulator and a method of operating a regulator.

A regulator is configured to consistently maintain a level of an output voltage at a target level. The regulator is being used in electronic devices that need a constant voltage. For example, when current consumption of a load increases, there is a tendency for the level of the output voltage to decrease. In this case, the level of the output voltage may be maintained at a target level by increasing the amount of output current.

For another example, when current consumption of the load decreases, there is a tendency for the level of the output voltage to increase. In this case, the level of the output voltage may be maintained at a target level by decreasing the amount of output current.

A regulator functioning as a current source or a voltage source in an electronic device, typically has a relatively large size compared with other components of the electronic device. Accordingly, there is a need for a regulator having a reduced size.

Also, if a speed at which the regulator responds to a change of the output voltage is slow, an abnormal operation may occur in the load using the output voltage. Accordingly, there is also a need for a regulator having an improved speed.

SUMMARY

Embodiments of the inventive concept provide a regulator having a reduced size and an improved response speed and an operating method of the regulator.

According to an exemplary embodiment, a regulator includes: a first resistor and a second resistor that are connected in series between a ground node and an output node; an amplifier that outputs an amplification voltage by comparing a reference voltage to a feedback voltage between the first resistor and the second resistor, and by amplifying a difference between the reference voltage and the feedback voltage; an analog-to-digital converter that converts the amplification voltage to a digital code; and a plurality of first transistors that are connected between a power node supplied with a power supply voltage and the output node and adjusts a current being supplied to the output node in response to the digital code.

According to an exemplary embodiment, a regulator includes: a first resistor and a second resistor that are connected in series between a ground node and an output node; an amplifier that outputs an amplification voltage by comparing a reference voltage to a feedback voltage obtained between the first resistor and the second resistor, and by amplifying a difference between the reference voltage and the feedback voltage; a digital block that discretely adjusts a first current being supplied to the output node depending on the amplification voltage, and an analog block that continuously adjusts a second current being supplied to the output node depending on the amplification voltage.

According to an exemplary embodiment, a method of operating a regulator includes dividing an output voltage of an output node to generate a feedback voltage, amplifying a difference between the feedback voltage and a reference voltage to generate an amplification voltage, supplying a digital current to the output node depending on the amplification voltage to perform coarse regulation of the output voltage, and supplying an analog current to the output node depending on the amplification voltage to perform fine regulation of the output voltage.

According to another exemplary embodiment, a method comprising: generating a feedback voltage based on an output voltage at an output node of a regulator; comparing the feedback voltage to a reference voltage and in response thereto producing a comparison voltage; converting the comparison voltage to a digital code; turning on a number, corresponding to the digital code, of a plurality of first transistors, each of which is connected between a power node and the output node to supply a first current to the output node; and controlling a second transistor, which is connected between the power node and the output node, in response to the comparison voltage to supply a second current to the output node.

BRIEF DESCRIPTION OF THE DRAWINGS

The above and other objects and features of the inventive concept will become apparent by describing in detail exemplary embodiments thereof with reference to the accompanying drawings.

DETAILED DESCRIPTION

Below, embodiments of the inventive concept may be described in detail and clearly to such an extent that an ordinary one in the art easily implements the inventive concept.

Figure 1:
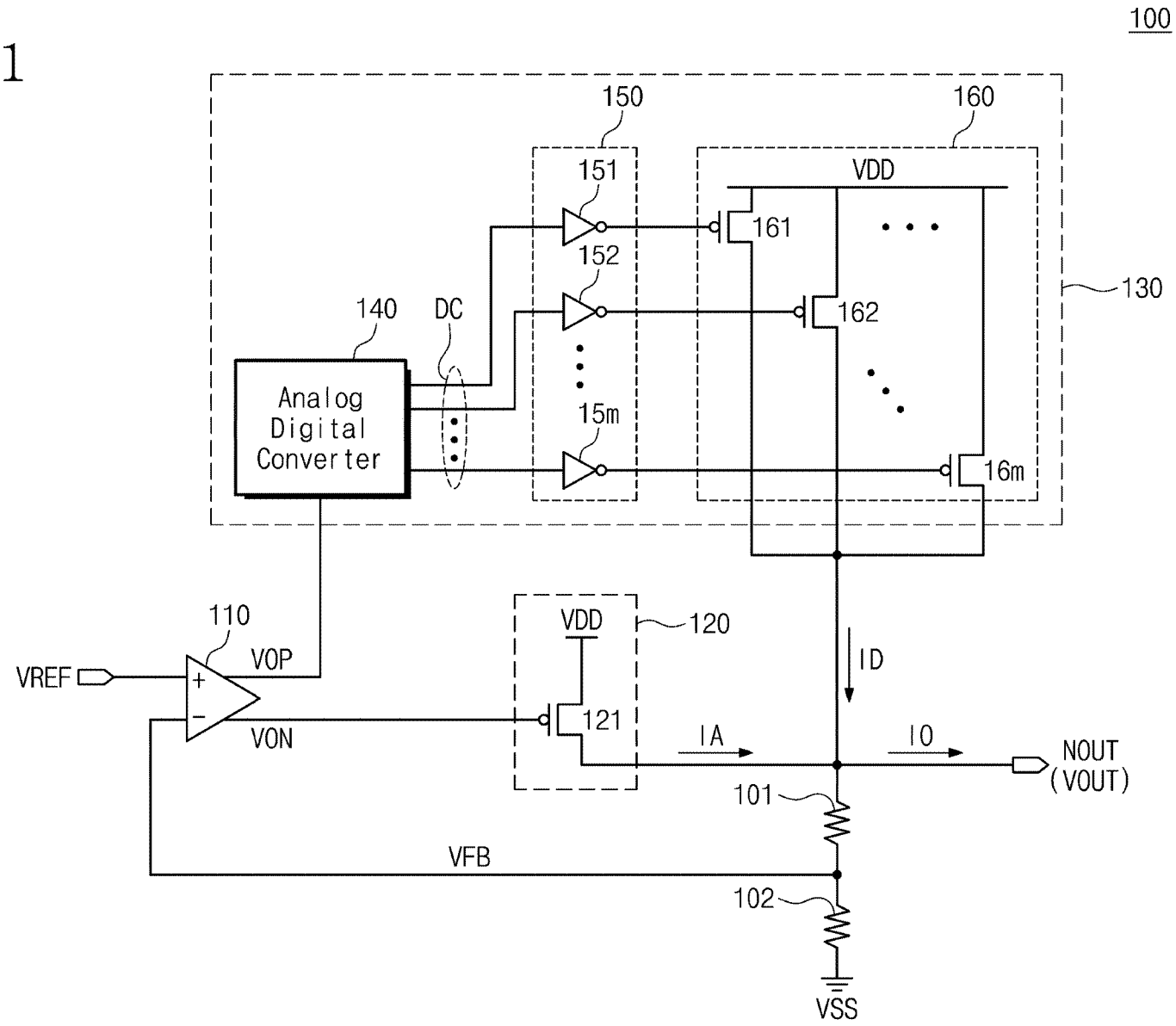
FIG. 1 illustrates an embodiment of a regulator.

FIG. 1 illustrates an embodiment of a regulator 100. Referring to FIG. 1, regulator 100 includes a first resistor 101, a second resistor 102, an amplifier 110, an analog block 120, and a digital block 130.

First resistor 101 and second resistor 102 are connected in series between an output node NOUT and a ground node to which a ground voltage VSS is supplied. First resistor 101 and second resistor 102 may generate a feedback voltage VFB by dividing an output voltage VOUT of the output node NOUT. For example, resistance values of first resistor 101 and second resistor 102 may be identical to each other or different from each other.

Amplifier 110 has a positive input to which a reference voltage VREF is applied and a negative input to which the feedback voltage VFB is applied. Amplifier 110 may compare the reference voltage VREF and the feedback voltage VFB. Amplifier 110 may amplify a difference between the reference voltage VREF and the feedback voltage VFB to output an amplification voltage VOP, which may also be referred to as a comparison voltage.

For example, if the reference voltage VREF is greater than the feedback voltage VFB, the amplification voltage VOP may increase to a positive voltage. As the difference between the reference voltage VREF and the feedback voltage VFB increases, the increment of the amplification voltage VOP may become greater. As the difference between the reference voltage VREF and the feedback voltage VFB decreases, the increment of the amplification voltage VOP may become smaller.

For example, if the reference voltage VREF is less than the feedback voltage VFB, the amplification voltage VOP may decrease to a negative voltage. As the difference between the reference voltage VREF and the feedback voltage VFB increases, the decrement of the amplification voltage VOP may become greater. As the difference between the reference voltage VREF and the feedback voltage VFB decreases, the decrement of the amplification voltage VOP may become smaller.

Amplifier 110 may further output an inverted amplification voltage VON, which may also be referred to as a negative comparison voltage. The inverted amplification voltage VON may have the same value as the amplification voltage VOP and an opposite sign to the amplification voltage VOP. The inverted amplification voltage VON may correspond to the inverted version of the amplification voltage VOP.

Analog block 120 may supply an analog current IA to the output node NOUT depending on the amplification voltage VOP, for example, the inverted amplification voltage VON. For example, the analog current IA is named in that a current is controlled according to an analog control, but embodiments are not limited thereto.

Analog block 120 include a second transistor 121 that is connected between a power node supplied with a power supply voltage VDD and the output node NOUT, and is controlled by the inverted amplification voltage VON. For example, second transistor 121 may include a PMOS transistor.

In response to the inverted amplification voltage VON, second transistor 121 may operate in a cutoff state where second transistor 121 is turned off, a triode state where the amount of the analog current IA is linearly adjusted, and a saturation state where the amount of the analog current IA is adjusted to have a maximum value.

If the inverted amplification voltage VON decreases, a channel of second transistor 121 is extended. Accordingly, second transistor 121 may increase the amount of the analog current IA. If the inverted amplification voltage VON increases, the channel of second transistor 121 is reduced. Accordingly, second transistor 121 may decrease the amount of the analog current IA.

The amount of the analog current IA is controlled by adjusting a channel size of second transistor 121 depending on the output voltage VOUT, for example, a difference between the feedback voltage VFB and the reference voltage VREF. That is, the amount of the analog current IA is controlled based on an analog value.

Digital block 130 may supply a digital current ID (referred to herein sometimes as a first current) to the output node NOUT depending on the amplification voltage VOP. For example, the digital current ID is named in that a current is controlled according to a digital control, but embodiments are not limited thereto.

Digital block 130 includes an analog-to-digital converter 140, a buffer unit 150, and a transistor unit 160. Analog-to-digital converter 140 may convert the amplification voltage VOP to a digital code DC. For example, analog-to-digital converter 140 may include a flash analog-to-digital converter that converts a level of the amplification voltage VOP to the digital code DC at one time. That is, the bit of the digital code may be all generated at a same time as each other.

For example, analog-to-digital converter 140 may adjust the number of 1's or 0's in the digital code DC depending on the level of the amplification voltage VOP. As the level of the amplification voltage VOP increases, analog-to-digital converter 140 may increase the number of 1's in the digital code DC. As the level of the amplification voltage VOP decreases, analog-to-digital converter 140 may decrease the number of 1's in the digital code DC. For example, analog-to-digital converter 140 may be a quantizer and a sampler that converts the level of the amplification voltage VOP to a quantized value or a discrete value.

Buffer unit 150 may include buffers 151 to **15*m* that receive the different bits of the digital code DC, respectively. For example, buffers 151 to 15*m*** may include inverters that invert the bits of the digital code DC.

Transistor unit 160 includes a plurality of first transistors 161 to **16*m* connected between the power node supplied with the power supply voltage VDD and the output node NOUT. First transistors 161 to 16*m* may operate in response to the digital code DC output from analog-to-digital converter 140, for example, outputs of buffers 151 to 15*m***.

The sizes of first transistors 161 to **16*m* may be identical to each other. First transistors 161 to 16*m* may operate in the cutoff state or in the saturation state in response to the digital code DC. The amounts of currents flowing through digitally controller transistors 161 to 16*m*** when they are turned on in the saturation state may be identical to each other.

If a specific bit of the digital code DC has a value of "1", a transistor, to which the specific bit is applied, from among first transistors 161 to **16*m* is turned on. If a specific bit of the digital code DC has a value of "0", a transistor, to which the specific code is applied, from among first transistors 161 to 16*m*** is turned off.

The digital current ID may correspond to a sum of currents that first transistors 161 to **16*m* supply to the output node NOUT. If the number of turned-on transistors of first transistors 161 to 16*m* increases, the amount of the digital current ID increases. If the number of turned-on transistors of first transistors 161 to 16*m*** decreases, the amount of the digital current ID decreases.

If the amplification voltage VOP increases (or decreases), the number of 1's of the digital code DC increases. Accordingly, the number of turned-on transistors among first transistors 161 to **16*m* increases, and the amount of the digital current ID increases. If the amplification voltage VOP decreases (or increases), the number of 1's of the digital code DC decreases. Accordingly, the number of turned-on transistors among first transistors 161 to 16***m* decreases, and the amount of the digital current ID decreases.

The amount of the digital current ID is controlled by adjusting the number of turned-on transistors of first transistors 161 to 16*m* depending on the output voltage VOUT, for example, a difference between the feedback voltage VFB and the reference voltage VREF. That is, the amount of the digital current ID is controlled based on a digital value.

An output current IO supplied to a load through the output node NOUT may correspond to a sum of the digital current ID and the analog current IA. If the amount of the output current IO increases, there is a tendency for the output voltage VOUT to decrease. Depending on the decreasing tendency of the output voltage VOUT, analog block 120 may increase the amount of the analog current IA, and/or digital block 130 may increase the amount of the digital current ID.

If the amount of the output current IO decreases, there is a tendency for the output voltage VOUT to increase. Depending on the increasing tendency of the output voltage VOUT, analog block 120 may decrease the amount of the analog current IA, and/or digital block 130 may decrease the amount of the digital current ID.

As analog block 120 adjusts the amount of the analog current IA (referred to herein sometimes as a second current) depending on the output voltage VOUT, and digital block 130 adjusts the amount of the digital current ID depending on the output voltage VOUT, the output voltage VOUT may be maintained at a target level.

In an embodiment, digital block 130 may perform coarse regulation, and analog block 120 may perform fine regulation. For example, transistor unit 160 may discretely adjust the amount of the digital current ID (e.g., the supply amount of current) in a unit of a current amount of one transistor. A current amount of one transistor of transistor unit 160 may be an adjustment unit in which digital block 130 adjusts the amount of the digital current ID.

A range from the amount of the analog current IA when a channel of second transistor 121 of analog block 120 is closed to the amount of the analog current IA when the channel of second transistor 121 of analog block 120 has a maximum size may be an adjustment range (e.g., a maximum adjustment range) in which analog block 120 adjusts the amount of the analog current IA. Analog block 120 may continuously adjust the amount of the analog current IA (i.e., the supply amount of current) within the adjustment range.

The adjustment unit of digital block 130 may be associated with the adjustment range of analog block 120. For example, the amount of current (e.g., the maximum amount of current) that second transistor 121 of analog block 120 provides, that is, the adjustment range may be associated with the amount of current that one transistor of first transistors 161 to 16*m* of digital block 130 provides, that is, the adjustment unit. That is the amount of current provided by second transistor 121 of analog block 120 may be similar to an amount of current provided by any one of first transistors 161 to 16*m* of digital block 130. Beneficially, the amount of current provided by second transistor 121 of analog block 120 may be slightly greater (e.g., 10% greater) than an amount of current provided by any one of first transistors 161 to 16*m* of digital block 130.

In an embodiment, the adjustment unit of digital block 130 may be determined or selected depending on the adjustment range of analog block 120. The adjustment unit of digital block 130 may be determined or selected to be similar to the adjustment range of analog block 120 or may be similarly determined to have a difference within a specific ratio percentage (e.g., 10%).

In an embodiment, the adjustment unit of analog block 120 may be determined or selected depending on the adjustment range of digital block 130. The adjustment unit of analog or selected block 120 may be determined or selected to be similar to the adjustment range of digital block 130 or may be similarly determined to have a difference within a specific ratio or percentage (e.g., 10%).

The size of second transistor 121 of analog block 120 may be associated with the size of one transistor of first transistors 161 to 16*m* of digital block 130. In an embodiment, as described above with regard to a current amount, the size of second transistor 121 may be determined depending on the size of each of first transistors 161 to 16*m*. For example, the size of second transistor 121 may be determined to be similar to the size of each of first transistors 161 to 16*m* or may be similarly determined to have a difference within a specific ratio or percentage.

Alternatively, the size of each of first transistors 161 to 16*m* may be determined depending on the size of second transistor 121. For example, the size of each of first transistors 161 to 16*m* may be determined to be similar to the size of second transistor 121 or may be similarly determined to have a difference within a specific ratio or percentage.

Digital block 130 may coarsely regulate the output voltage VOUT depending on the adjustment unit. Analog block 120 may finely regulate the output voltage VOUT depending on the adjustment unit.

According to an embodiment, regulator 100 is implemented with a combination of analog block 120 and digital block 130. Digital block 130 may convert the amplification voltage VOP to the digital code DC at one time and coarsely regulates the output voltage VOUT depending on the digital code DC. Accordingly, a response speed of digital block 130 is improved.

Analog block 120 may additionally finely regulate a voltage, which is coarsely regulated by digital block 130, to a target level of the output voltage VOUT. The amount of current that analog block 120 supplies is smaller than the amount of current that digital block 130 supplies. Accordingly, the size of analog block 120 is reduced. As digital block 130 and analog block 120 are combined, regulator 100 having a reduced size and improved response speed may be provided.

Figure 2:
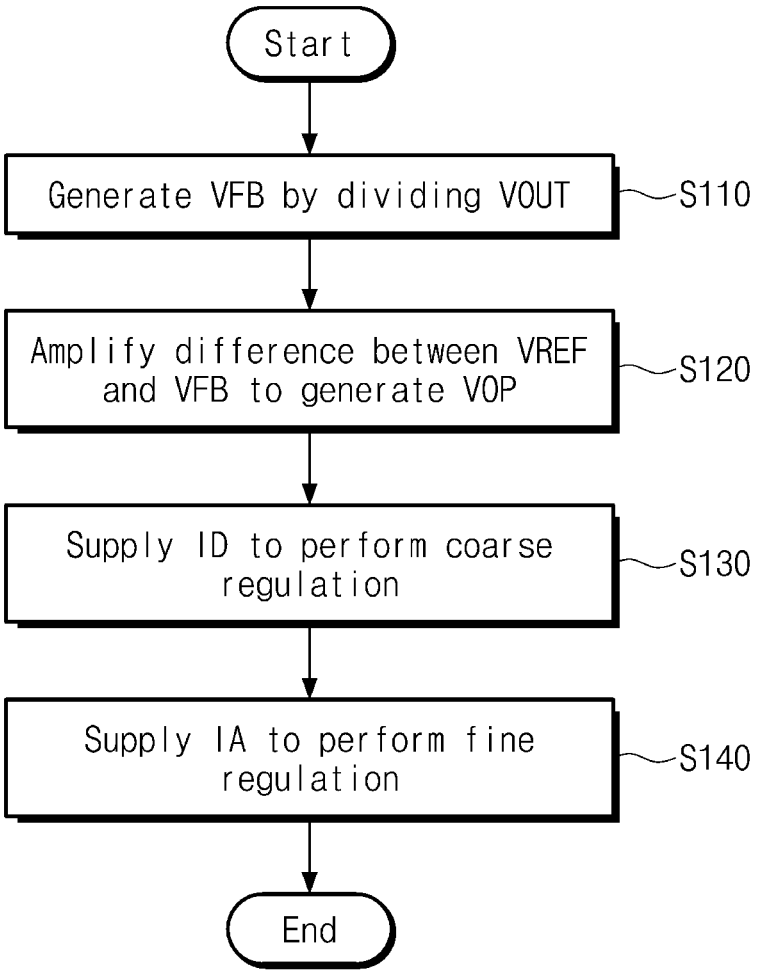
FIG. 2 is a flowchart illustrating an embodiment of an operating method of a regulator.

FIG. 2 is a flowchart illustrating an embodiment of an operating method of regulator 100. Referring to FIGS. 1 and 2, in operation S110, first resistor 101 and second resistor 102 may generate the feedback voltage VFB by dividing the output voltage VOUT. In operation S120, amplifier 110 may amplify a difference between the reference voltage VREF and the feedback voltage VFB to output the amplification voltage VOP.

In operation S130, digital block 130 may supply the digital current ID to the output node NOUT depending on the amplification voltage VOP to perform coarse regulation. Digital block 130 may adjust the amount of the digital current ID in an adjustment unit such that the output voltage VOUT is close to a target level.

In operation S140, analog block 120 may supply the analog current IA to the output node NOUT depending on the amplification voltage VOP, for example, the inverted amplification voltage VON to perform fine regulation. Analog block 120 may adjust the amount of the analog current IA within its adjustment range such that the output voltage VOUT reaches the target level.

Figure 3:
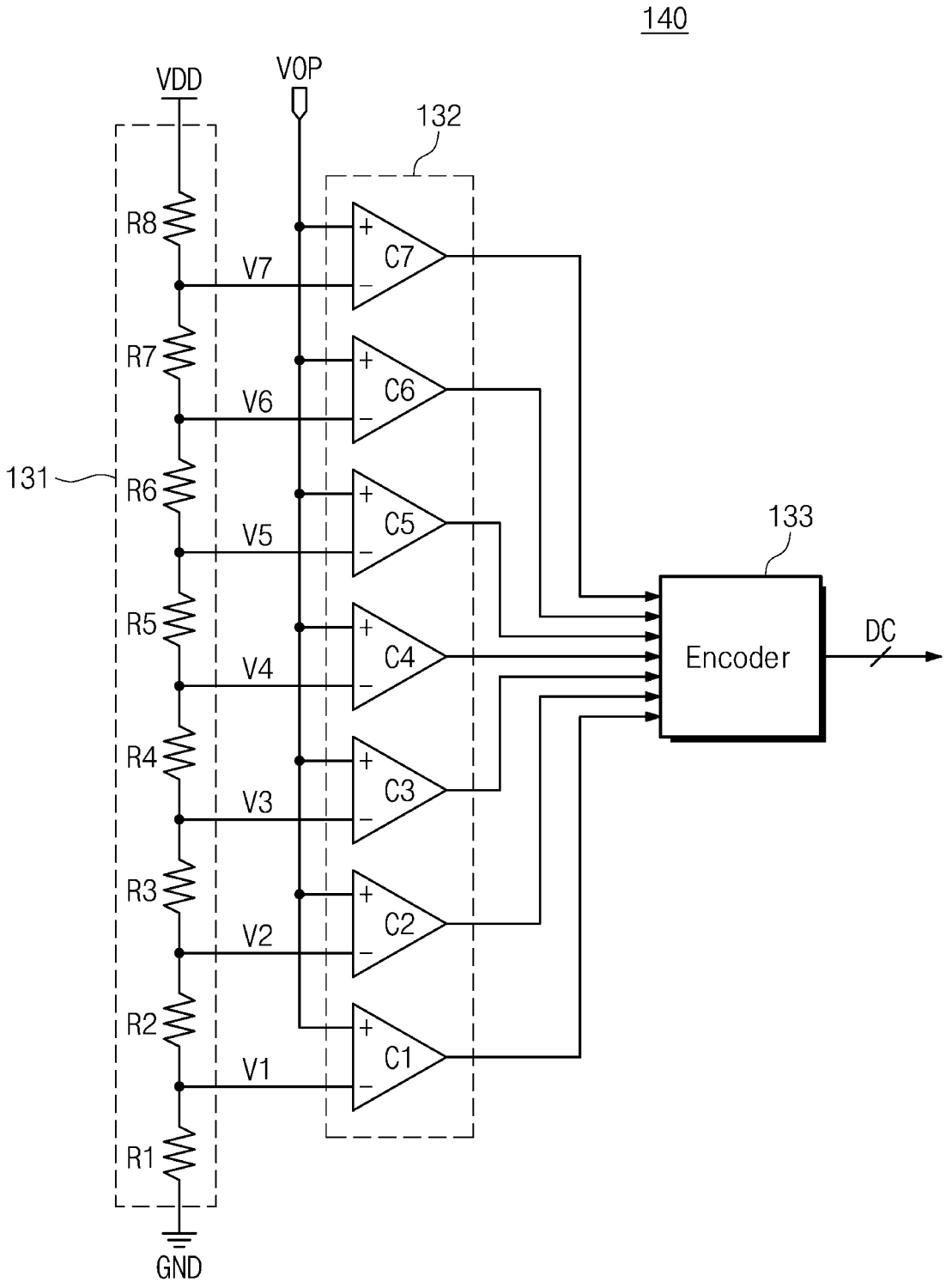
FIG. 3 illustrates an embodiment of an analog-to-digital converter t.

FIG. 3 illustrates an embodiment of analog-to-digital converter 140. Referring to FIGS. 1 and 3, analog-to-digital converter 140 includes a resistor unit 131, a comparator unit 132, and an encoder 133.

Resistor unit 131 includes first to eighth resistors R1 to R8 that are connected between the power node supplied with the power supply voltage VDD and the ground node supplied with the ground voltage VSS. The first to eighth resistors R1 to R8 may be connected in series with each other. Resistance values of the resistors R1 to R8 may be identical to each other or different from each other.

The resistance values of the resistors R1 to R8 may be adjusted depending on a range of the amplification voltage VOP that analog-to-digital converter 140 intends to convert to the digital code DC. For example, when the amplification voltage VOP is linearly converted to the digital code DC, at least first to seventh resistors R1 to R7 may have the same resistance value as each other.

For example, when the amplification voltage VOP is converted to the digital code DC in a log scale, the resistance values of the first to seventh resistors R1 to R7 may vary with the log scale. The eighth resistor R8 may vary with a maximum level of the amplification voltage VOP. When the maximum level of the amplification voltage VOP is not less than the power supply voltage VDD, the eighth resistor R8 may be omitted.

Comparator unit 132 includes first to seventh comparators C1 to C7. The first to seventh comparators C1 to C7 may compare the amplification voltage VOP with corresponding voltages V1 to V7 between the first to eighth resistors R1 to R8. For example, a k-th comparator (k being a positive integer) may compare the amplification voltage VOP with a k-th voltage between a k-th resistor and a (k+1)-th resistor.

Each of the first to seventh comparators C1 to C7 has a positive input to which the amplification voltage VOP is applied and a negative input to which a corresponding one of the voltages V1 to V7 is applied. Each of the first to seventh comparators C1 to C7 may output a high level when the amplification voltage VOP is greater than (or not equal to or not smaller than) the corresponding one of the voltages V1 to V7. Each of the first to seventh comparators C1 to C7 may output a low level when the amplification voltage VOP is less than or equal to (or not greater than) the corresponding one of the voltages V1 to V7.

Encoder 133 may convert a comparison result of comparator unit 132 to the digital code DC. For example, encoder 133 may convert an output of comparator unit 132 to one of "m" digital codes DC respectively corresponding to first transistors 161 to 16*m*. When the number of digital codes DC is "m", the number of comparators of comparator unit 132 may be "m−1". For another example, "m−1" comparators may be provided in comparator unit 132 with regard to the "m" first transistors 161 to 16*m*.

Figure 4:
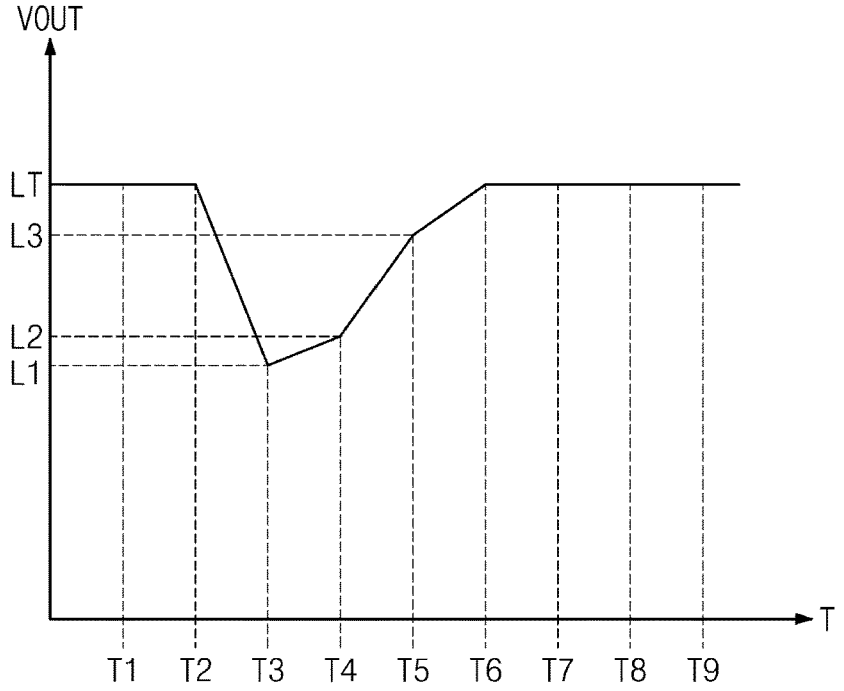
FIG. 4 illustrates an example in which an output voltage varies in the regulator of FIG. 1.

FIG. 4 illustrates an example in which the output voltage VOUT varies in regulator 100 of FIG. 1. In FIG. 4, a horizontal axis represents a time "T", and a vertical axis represents the output voltage VOUT. Referring to FIGS. 1 and 4, the output voltage VOUT may be maintained at a target level LT during a time interval from a first time T1 to a second time T2. At the second time T2, power consumption of a load connected to the output node NOUT may increase. That is, the amount of the output current IO used to drive the load may increase.

If the amount of the output current IO used becomes greater than the supply amount of the output current IO, the output voltage VOUT may decrease. The output voltage VOUT may decrease from the target level LT to a first level L1 during a time interval from the second time T2 to a third time T3.

An embodiment is illustrated in FIG. 4 as the output voltage VOUT linearly decreases during the time interval from the second time T2 to the third time T3. However, this is for describing the technical idea briefly, and a change of the output voltage VOUT is not limited to being linear. For example, the output voltage VOUT may vary from the target level LT to the first level L1 in the form of an exponential function or an inverse exponential function, or in any other form.

At the third time T3, the output voltage VOUT may have the first level L1 which is less than the target level LT. Accordingly, regulator 100 may perform a regulation operation. For example, digital block 130 may increase the amount of the digital current ID (e.g., the supply amount of the digital current ID), and/or analog block 120 may increase the amount of the analog current IA (e.g., the supply amount of the analog current IA).

If the supply amount of the digital current ID increases and the supply amount of the analog current IA increases, the supply amount of the output current IO increases. Accordingly, the output voltage VOUT may increase. For example, the output voltage VOUT may increase from the first level L1 to a second level L2 during a time interval from the third time T3 to a fourth time T4.

In an embodiment, during the time interval from the third time T3 to the fourth time T4, the output voltage VOUT may change from the first level L1 to the second level L2 in the form of a linear function, an exponential function, or an inverse exponential function, or in any other form.

At the fourth time T4, the output voltage VOUT may have the second level L2 which is still less than the target level LT. Accordingly, digital block 130 may increase the amount of the digital current ID (e.g., the supply amount of the digital current ID). In an embodiment, analog block 120 may adjust the supply amount of the analog current IA to a maximum value within its adjustment range already at the third time T3. Accordingly, analog block 120 may not additionally adjust the supply amount of the analog current IA.

For example, the output voltage VOUT may increase from the second level L2 to a third level L3 during a time interval from the fourth time T4 to a fifth time T5. In an embodiment, the output voltage VOUT may change from the second level L2 to the third level L3 in the form of a linear function, an exponential function, or an inverse exponential function, or in any other form.

At the fifth time T5, the output voltage VOUT may have the third level L3 which is still less than the target level LT. Accordingly, digital block 130 may increase the amount of the digital current ID (e.g., the supply amount of the digital current ID).

As the output voltage VOUT comes close to the target level LT, analog block 120 may adjust the amount of the analog current IA such that the output voltage VOUT reaches the target level. For example, analog block 120 may adjust the amount of the analog current IA from the maximum value within its adjustment range to any value corresponding to the target level LT.

Accordingly, the output voltage VOUT may be adjusted from the third level L3 to the target level LT during a time interval from the fifth time T5 to a sixth time T6. After the sixth time T6, for example, during a time interval from the sixth time T6 to a ninth time T9, regulator 100 may maintain the output voltage VOUT at the target level LT.

Figure 5:
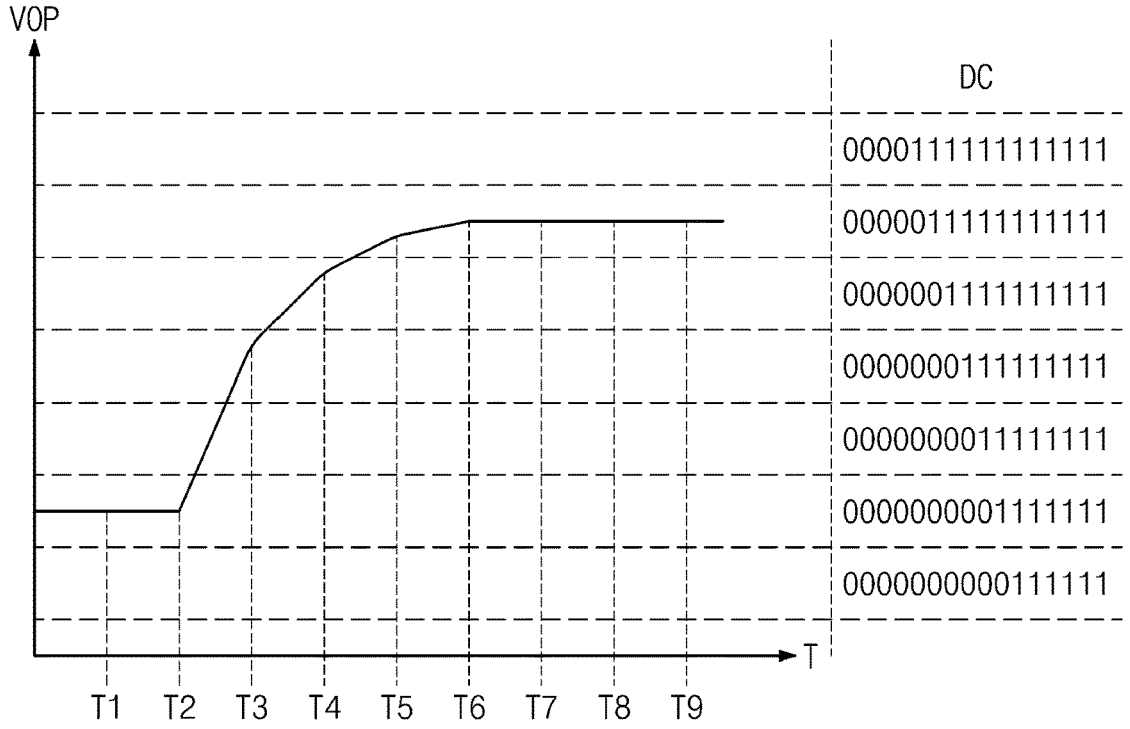
FIG. 5 illustrates an example in which a digital code is generated depending on an amplification voltage.

FIG. 5 illustrates an example in which the digital code DC is generated depending on the amplification voltage VOP. In FIG. 5, a horizontal axis represents a time "T", and a vertical axis represents the amplification voltage VOP. Referring to FIGS. 1, 4, and 5, the reference voltage VREF may be set to be greater than the feedback voltage VFB.

In an embodiment, it is assumed that the number of first transistors 161 to 16*m* is 16. That is, it is assumed that the digital code DC includes 16 bits respectively corresponding to 16 transistors.

The output voltage VOUT may be maintained at the target level LT during the time interval from the first time T1 to the second time T2. As the output voltage VOUT is maintained at the target level LT, the feedback voltage VFB and the amplification voltage VOP are maintained to be constant. In this case, the amplification voltage VOP may be converted to the digital code DC of "0000000001111111". Depending on the digital code DC, seven transistors of first transistors 161 to 16*m* may be turned on, and nine transistors thereof may be turned off.

As the output voltage VOUT starts to decrease at the second time T2, the feedback voltage VFB may also decrease. As the feedback voltage VFB decreases, a difference between the reference voltage VREF and the feedback voltage VFB increases. Accordingly, the amplification voltage VOP may increase between the second time T2 and the third time T3.

An embodiment is illustrated in FIG. 5 as the amplification voltage VOP linearly increases during the time interval from the second time T2 to the third time T3. However, this is for describing the technical idea briefly, and a change of the amplification voltage VOP is not limited as being linear. For example, the amplification voltage VOP may vary in the form of an exponential function or an inverse exponential function, or in any other form.

At the third time T3, the amplification voltage VOP may be converted to the digital code DC of "0000000111111111". Depending on the digital code DC, nine transistors of first transistors 161 to 16*m* may be turned on, and seven transistors thereof may be turned off. As the digital code DC is changed, the amount of the digital current ID that digital block 130 supplies increases.

Even though the digital code DC is changed at the third time T3, the output voltage VOUT is still less than the target level LT. Accordingly, the amplification voltage VOP increases during the time interval from the third time T3 to the fourth time T4. For example, the rate of increase of the amplification voltage VOP from the third time T3 to the fourth time T4 may be less than the rate of increase during the time interval from the second time T2 to the third time T3. In an embodiment, during the time interval from the third time T3 to the fourth time T4, the amplification voltage VOP may change in the form of a linear function, an exponential function, or an inverse exponential function, or in any other form.

At the fourth time T4, the amplification voltage VOP may be converted to the digital code DC of "0000001111111111". Depending on the digital code DC, ten transistors of first transistors 161 to 16*m* may be turned on, and six transistors thereof may be turned off. As the digital code DC is changed, the amount of the digital current ID that digital block 130 supplies increases.

Even though the digital code DC is changed at the fourth time T4, the output voltage VOUT is still less than the target level LT. Accordingly, the amplification voltage VOP increases during the time interval from the fourth time T4 to the fifth time T5. For example, the rate of increase of the amplification voltage VOP from the fourth time T4 to the fifth time T5 may be less than the rate of increase during the time interval from the third time T3 to the fourth time T4. In an embodiment, during the time interval from the fourth time T4 to the fifth time T5, the amplification voltage VOP may change in the form of a linear function, an exponential function, or an inverse exponential function, or in any other form.

At the fifth time T5, the amplification voltage VOP may be converted to the digital code DC of "0000011111111111". Depending on the digital code DC, eleven transistors of first transistors 161 to 16*m* may be turned on, and five transistors thereof may be turned off. As the digital code DC is changed, the amount of the digital current ID that digital block 130 supplies increases.

If the digital code DC is changed at the fifth time T5, during the time interval from the fifth time T5 to the sixth time T6, the output voltage VOUT increases and reaches the target level LT. Accordingly, after the amplification voltage VOP increases during the time interval from the fifth time T5 to the sixth time T6, the amplification voltage VOP may be maintained to be constant. In an embodiment, during the time interval from the fifth time T5 to the sixth time T6, the amplification voltage VOP may change in the form of a linear function, an exponential function, or an inverse exponential function, or in any other form.

As the amplification voltage VOP is maintained to be constant, the digital code DC may also be maintained to be constant. After the sixth time T6, for example, during the time interval from the sixth time T6 to the ninth time T9, regulator 100 may maintain the output voltage VOUT at the target level LT.

Figure 6:
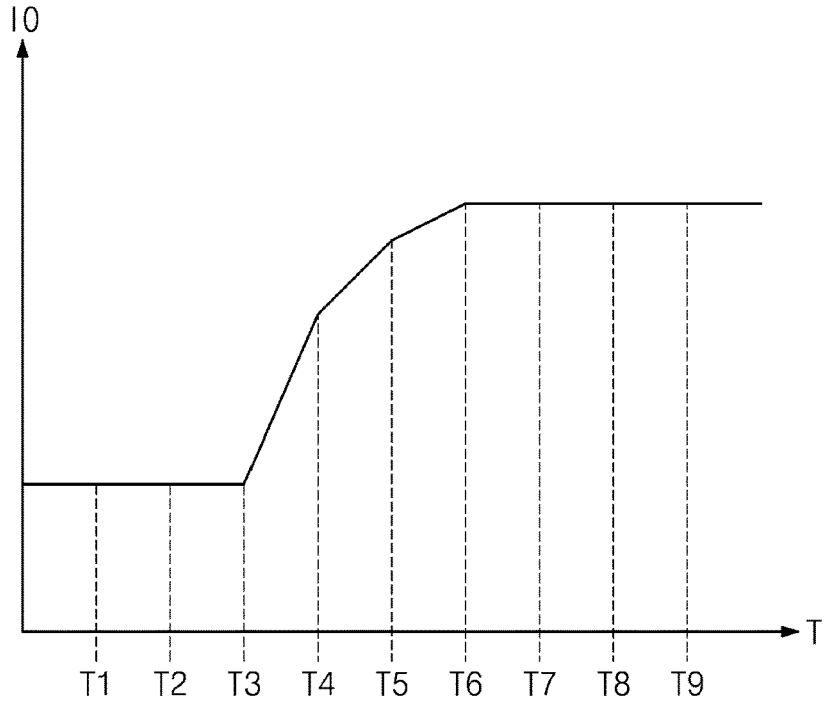
FIG. 6 illustrates an example in which the supply amount of output current varies with an amplification voltage.

FIG. 6 illustrates an example in which the supply amount of the output current IO varies with the amplification voltage VOP. In FIG. 6, a horizontal axis represents a time "T", and a vertical axis represents the output current IO. For example, the supply amount of the output current IO may correspond to a sum of the supply amount of the analog current IA that analog block 120 supplies and the supply amount of the digital current ID that digital block 130 supplies.

Referring to FIGS. 1 and 4 to 6, the digital code DC may be maintained to be constant at "0000000001111111" during the time interval from the first time T1 to the second time T2. Accordingly, the supply amount of the output current IO may also be maintained to be constant.

In response to the change of the output voltage, analog block 120 may start to increase the supply amount of the analog current IA at the second time T2. However, in order to describe operations of digital block 130 more clearly, the change of the supply amount of the analog current IA may be ignored.

The digital code DC is changed to "0000000111111111" at the third time T3. Accordingly, at the third time T3, digital block 130 may increase the supply amount of the digital current ID. That is, during the time interval from the third time T3 to the fourth time T4, the supply amount of the output current IO increases depending on the change of the digital code DC.

An embodiment is illustrated in FIG. 6 as the output current IO linearly increases during the time interval from the third time T3 to the fourth time T4. However, this is for describing the technical idea briefly, and a change of the output current IO is not limited as being linear. For example, the output current IO may vary in the form of an exponential function or an inverse exponential function, or in any other form.

The digital code DC is changed to "0000001111111111" at the fourth time T4. Accordingly, at the fourth time T4, digital block 130 may increase the supply amount of the digital current ID. That is, during the time interval from the fourth time T4 to the fifth time T5, the supply amount of the output current IO increases. In an embodiment, the output current IO may vary in the form of a linear function, an exponential function, or an inverse exponential function, or in any other form.

In an embodiment, during the time interval from the third time T3 to the fourth time T4, analog block 120 may already adjust the supply amount of the analog current IA to the maximum value within its adjustment range. Accordingly, during the time interval from the fourth time T4 to the fifth time T5, analog block 120 may not additionally adjust the supply amount of the analog current IA.

The digital code DC is changed to "0000011111111111" at the fifth time T5. Accordingly, at the fifth time T5, digital block 130 may increase the supply amount of the digital current ID. That is, during the time interval from the fifth time T5 to the sixth time T6, the supply amount of the output current IO increases. In an embodiment, the output current IO may vary in the form of a linear function, an exponential function, or an inverse exponential function, or in any other form.

As the output voltage VOUT comes close to the target level LT, analog block 120 may adjust the supply amount of the analog current IA such that the output voltage VOUT reaches the target level LT. For example, analog block 120 may adjust the supply amount of the analog current IA from the maximum value within its adjustment range to any value corresponding to the target level LT.

At the sixth time T6, the output current IO may maintain a constant level by a combination of the digital current ID and the analog current IA. For example, the supply amount of the output current IO may be maintained to be similar to the amount of current used by the load.

Figure 7:
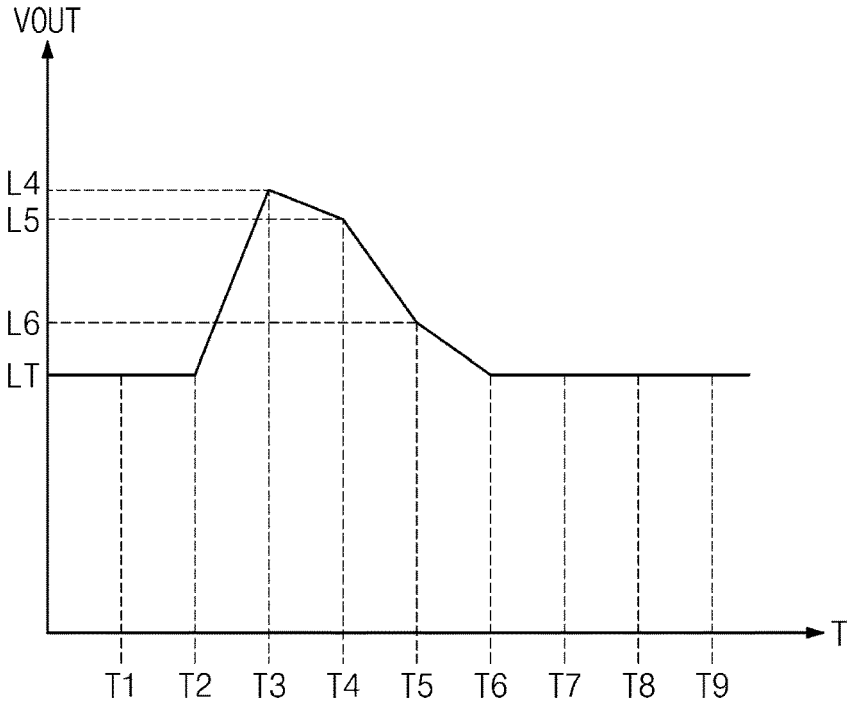
FIG. 7 illustrates another example in which an output voltage varies in the regulator of FIG. 1.

FIG. 7 illustrates another example in which the output voltage VOUT varies in regulator 100 of FIG. 1. In FIG. 7, a horizontal axis represents a time "T", and a vertical axis represents the output voltage VOUT. Referring to FIGS. 1 and 7, the output voltage VOUT may be maintained at a target level LT during a time interval from a first time T1 to a second time T2. At the second time T2, power consumption of a load connected to the output node NOUT may decrease. That is, the amount of the output current IO used to drive the load may decrease.

If the amount of the output current IO used by the load becomes less than the supply amount of the output current IO, the output voltage VOUT may increase. The output voltage VOUT may increase from the target level LT to a fourth level L4 during a time interval from the second time T2 to a third time T3.

An embodiment is illustrated in FIG. 7 as the output voltage VOUT linearly increases during the time interval from the second time T2 to the third time T3. However, this is for describing the technical idea briefly, and a change of the output voltage VOUT is not limited to being linear. For example, the output voltage VOUT may vary from the target level LT to the fourth level L4 in the form of an exponential function or an inverse exponential function, or in any other form.

At the third time T3, the output voltage VOUT may have the fourth level L4 which is greater than the target level LT. Accordingly, regulator 100 may perform a regulation operation. For example, digital block 130 may decrease the amount of the digital current ID (e.g., the supply amount of the digital current ID), and analog block 120 may decrease the amount of the analog current IA (e.g., the supply amount of the analog current IA).

If the supply amount of the digital current ID decreases and the supply amount of the analog current IA decreases, the supply amount of the output current IO decreases. Accordingly, the output voltage VOUT may decrease. For example, the output voltage VOUT may decrease from the fourth level L4 to a fifth level L5 during a time interval from the third time T3 to a fourth time T4.

In an embodiment, during the time interval from the third time T3 to the fourth time T4, the output voltage VOUT may change from the fourth level L4 to the fifth level L5 in the form of a linear function, an exponential function, or an inverse exponential function, or in any other form.

At the fourth time T4, the output voltage VOUT may have the fifth level L5 which is still greater than the target level LT. Accordingly, digital block 130 may decrease the amount of the digital current ID (e.g., the supply amount of the digital current ID). In an embodiment, analog block 120 may adjust the supply amount of the analog current IA to a minimum value within its adjustment range already at the third time T3. Accordingly, analog block 120 may not additionally adjust the supply amount of the analog current IA.

The output voltage VOUT may decrease from the fifth level L5 to a sixth level L6 during a time interval from the fourth time T4 to a fifth time T5. In an embodiment, the output voltage VOUT may change from the fifth level L5 to the sixth level L6 in the form of a linear function, an exponential function, or an inverse exponential function, or in any other form.

At the fifth time T5, the output voltage VOUT may have the sixth level L6 higher than the target level LT. Accordingly, digital block 130 may decrease the amount of the digital current ID (e.g., the supply amount of the digital current ID).

As the output voltage VOUT comes close to the target level LT, analog block 120 may adjust the amount of the analog current IA such that the output voltage VOUT reaches the target level LT. For example, analog block 120 may adjust the amount of the analog current IA from the minimum value within its adjustment range to any value corresponding to the target level LT.

Accordingly, the output voltage VOUT is adjusted from the sixth level L6 to the target level LT during a time interval from the fifth time T5 to a sixth time T6. After the sixth time T6, for example, during a time interval from the sixth time T6 to a ninth time T9, regulator 100 may maintain the output voltage VOUT at the target level LT.

Figure 8:
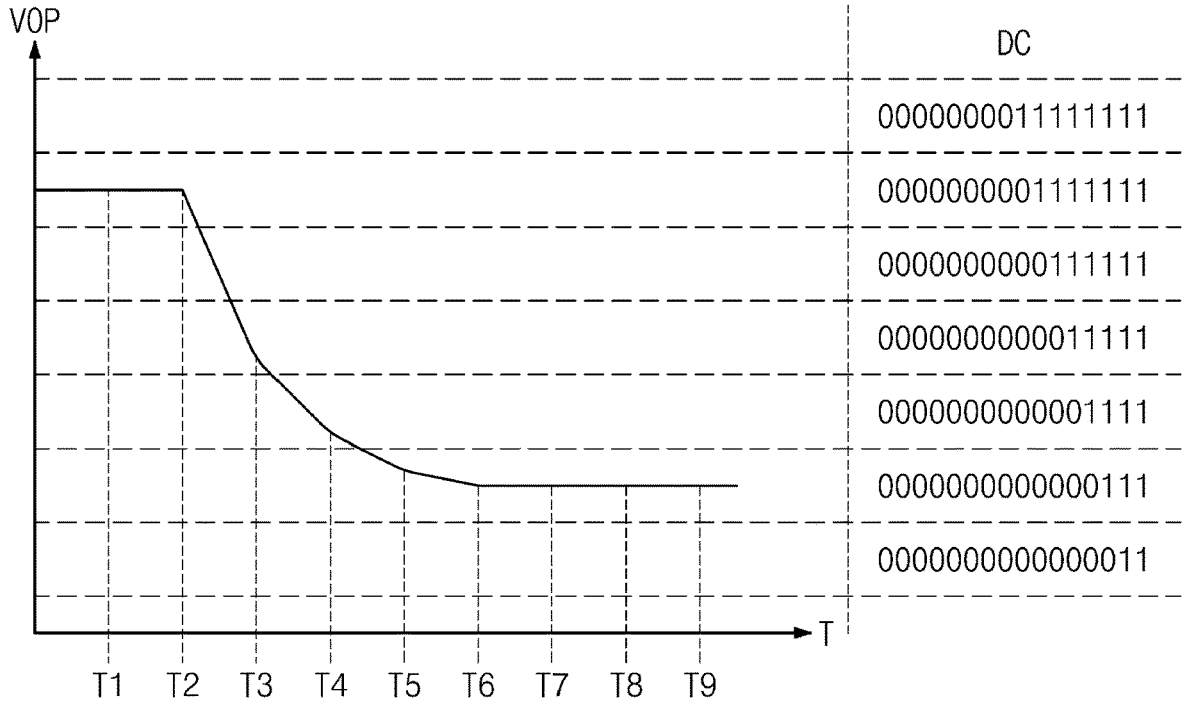
FIG. 8 illustrates an example in which a digital code is generated depending on an amplification voltage.

FIG. 8 illustrates an example in which the digital code DC is generated depending on the amplification voltage VOP. In FIG. 8, a horizontal axis represents a time "T", and a vertical axis represents the amplification voltage VOP. Referring to FIGS. 1, 7, and 8, the reference voltage VREF may be set to be greater than the feedback voltage VFB.

In an embodiment, it is assumed that the number of first transistors 161 to 16*m* is 16. That is, it is assumed that the digital code DC includes 16 bits respectively corresponding to 16 transistors.

The output voltage VOUT may be maintained at the target level LT during the time interval from the first time T1 to the second time T2. As the output voltage VOUT is maintained at the target level LT, the feedback voltage VFB and the amplification voltage VOP are maintained to be constant. In this case, the amplification voltage VOP may be converted to the digital code DC of "0000000001111111". Depending on the digital code DC, seven transistors of first transistors 161 to 16*m* may be turned on, and nine transistors thereof may be turned off.

As the output voltage VOUT starts to increase at the second time T2, the feedback voltage VFB may also increase. As the feedback voltage VFB increases, a difference between the reference voltage VREF and the feedback voltage VFB decreases. Accordingly, the amplification voltage VOP may decrease between the second time T2 and the third time T3.

An embodiment is illustrated in FIG. 8 as the amplification voltage VOP linearly decreases during the time interval from the second time T2 to the third time T3. However, this is for describing the technical idea briefly, and a change of the amplification voltage VOP is not limited as being linear. For example, the amplification voltage VOP may vary in the form of an exponential function or an inverse exponential function, or in any other form.

At the third time T3, the amplification voltage VOP may be converted to the digital code DC of "0000000000011111". Depending on the digital code DC, five transistors of first transistors 161 to 16*m* may be turned on, and eleven transistors thereof may be turned off. As the digital code DC is changed, the amount of the digital current ID that digital block 130 supplies decreases.

Even though the digital code DC is changed at the third time T3, the output voltage VOUT is still greater than the target level LT. Accordingly, the amplification voltage VOP decreases during the time interval from the third time T3 to the fourth time T4. For example, the rate of decrease of the amplification voltage VOP from the third time T3 to the fourth time T4 may be less than the rate of decrease during the time interval from the second time T2 to the third time T3. In an embodiment, during the time interval from the third time T3 to the fourth time T4, the amplification voltage VOP may change in the form of a linear function, an exponential function, or an inverse exponential function, or in any other form.

At the fourth time T4, the amplification voltage VOP may be converted to the digital code DC of "0000000000001111". Depending on the digital code DC, four transistors of first transistors 161 to 16*m* may be turned on, and twelve transistors thereof may be turned off. As the digital code DC is changed, the amount of the digital current ID that digital block 130 supplies decreases.

Even though the digital code DC are changed at the fourth time T4, the output voltage VOUT is still greater than the target level LT. Accordingly, the amplification voltage VOP decreases during the time interval from the fourth time T4 to the fifth time T5. For example, the rate of decrease of the amplification voltage VOP during the time interval from the fourth time T4 to the fifth time T5 may be less than with the rate of decrease during the time interval from the third time T3 to the fourth time T4. In an embodiment, during the time interval from the fourth time T4 to the fifth time T5, the amplification voltage VOP may change in the form of a linear function, an exponential function, or an inverse exponential function, or in any other form.

At the fifth time T5, the amplification voltage VOP may be converted to the digital code DC of "0000000000000111". Depending on the digital code DC, three transistors first transistors 161 to 16*m* may be turned on, and thirteen transistors thereof may be turned off. As the digital code DC is changed, the amount of the digital current ID that digital block 130 supplies decreases.

If the digital code DC is changed at the fifth time T5, during the time interval from the fifth time T5 to the sixth time T6, the output voltage VOUT decreases and reaches the target level LT. Accordingly, after the amplification voltage VOP decreases during the time interval from the fifth time T5 to the sixth time T6, the amplification voltage VOP may be maintained to be constant. In an embodiment, during the time interval from the fifth time T5 to the sixth time T6, the amplification voltage VOP may change in the form of a linear function, an exponential function, or an inverse exponential function, or in any other form.

As the amplification voltage VOP is maintained to be constant, the digital code DC may also be maintained to be constant. After the sixth time T6, for example, during the time interval from the sixth time T6 to the ninth time T9, the amplification voltage VOP may be maintained uniformly.

Figure 9:
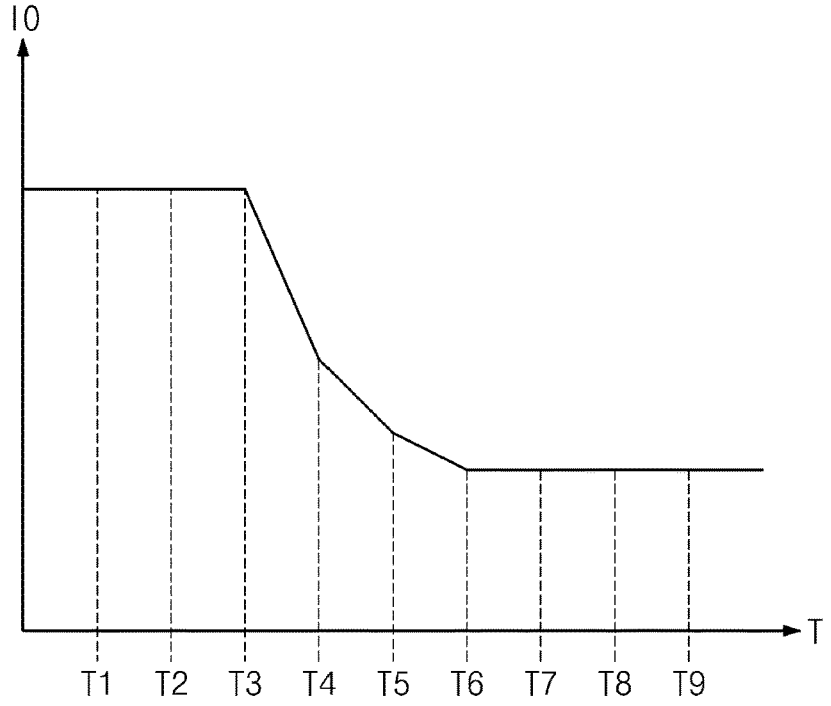
FIG. 9 illustrates an example in which the supply amount of output current varies with an amplification voltage.

FIG. 9 illustrates an example in which the supply amount of the output current IO varies with the amplification voltage VOP. In FIG. 9, a horizontal axis represents a time "T", and a vertical axis represents the output current IO. For example, the supply amount of the output current IO may correspond to a sum of the supply amount of the analog current IA that analog block 120 supplies and the supply amount of the digital current ID that the digital block 130 supplies.

Referring to FIGS. 1 and 7 to 9, the digital code DC may be maintained to be constant at "0000000001111111" during the time interval from the first time T1 to the second time T2. Accordingly, the supply amount of the output current IO may also be maintained to be constant.

The digital code DC is changed to "0000000000011111" at the third time T3. Accordingly, at the third time T3, the digital block 130 may decrease the supply amount of the digital current ID. That is, during the time interval from the third time T3 to the fourth time T4, the supply amount of the output current IO decreases depending on the change of the digital code DC. At the same time, the analog block 120 may also decrease the supply of the analog current IA.

An embodiment is illustrated in FIG. 9 as the output current IO linearly decreases during the time interval from the third time T3 to the fourth time T4. However, this is for describing the technical idea briefly, and a change of the output current IO is not limited to being linear. For example, the output current IO may vary in the form of an exponential function or an inverse exponential function, or in any other form.

The digital code DC is changed to "0000000000001111" at the fourth time T4. Accordingly, at the fourth time T4, digital block 130 may decrease the supply amount of the digital current ID. That is, during the time interval from the fourth time T4 to the fifth time T5, the supply amount of the output current IO decreases. In an embodiment, the output current IO may vary in the form of a linear function, an exponential function, or an inverse exponential function, or in any other form.

In an embodiment, during the time interval from the third time T3 to the fourth time T4, analog block 120 may already adjust the supply amount of the analog current IA to the minimum value within its adjustment range. Accordingly, during the time interval from the fourth time T4 to the fifth time T5, analog block 120 may not additionally adjust the supply amount of the analog current IA.

The digital code DC is changed to "0000000000000111" at the fifth time T5. Accordingly, at the fifth time T5, digital block 130 may decrease the supply amount of the digital current ID. That is, during the time interval from the fifth time T5 to the sixth time T6, the supply amount of the output current IO decreases. In an embodiment, the output current IO may vary in the form of a linear function, an exponential function, or an inverse exponential function, or in any other form.

As the output voltage VOUT comes close to the target level LT, analog block 120 may adjust the supply amount of the analog current IA such that the output voltage VOUT reaches the target level LT. For example, analog block 120 may adjust the supply amount of the analog current IA from the minimum value within its adjustment range to any value corresponding to the target level LT.

At the sixth time T6, the output current IO may maintain a constant level by a combination of the digital current ID and the analog current IA. For example, the supply amount of the output current IO may be maintained to be similar to the amount of current used by the load.

As described above, an embodiment of regulator 100 may perform a regulation operation by combining the digital current ID of digital block 130 and the analog current IA of analog block 120. As a great part of regulation of the output voltage VOUT is processed by digital block 130, the size of regulator 100 may be reduced compared to a device which only employs analog regulation.

As fine regulation of the output voltage VOUT is processed by analog block 120, digital block 130 is allowed to coarsely regulate the output voltage VOUT. Accordingly, a response speed of digital block 130 is improved by using fast and coarse components like a flash analog-to-digital converter.

The output voltage VOUT may be converged on the target level LT because regulator 100 uses analog block 120. Accordingly, compared with a digital regulator where a ripple is present in an output voltage, regulator 100 having improved reliability and accuracy is provided.

Figure 10:
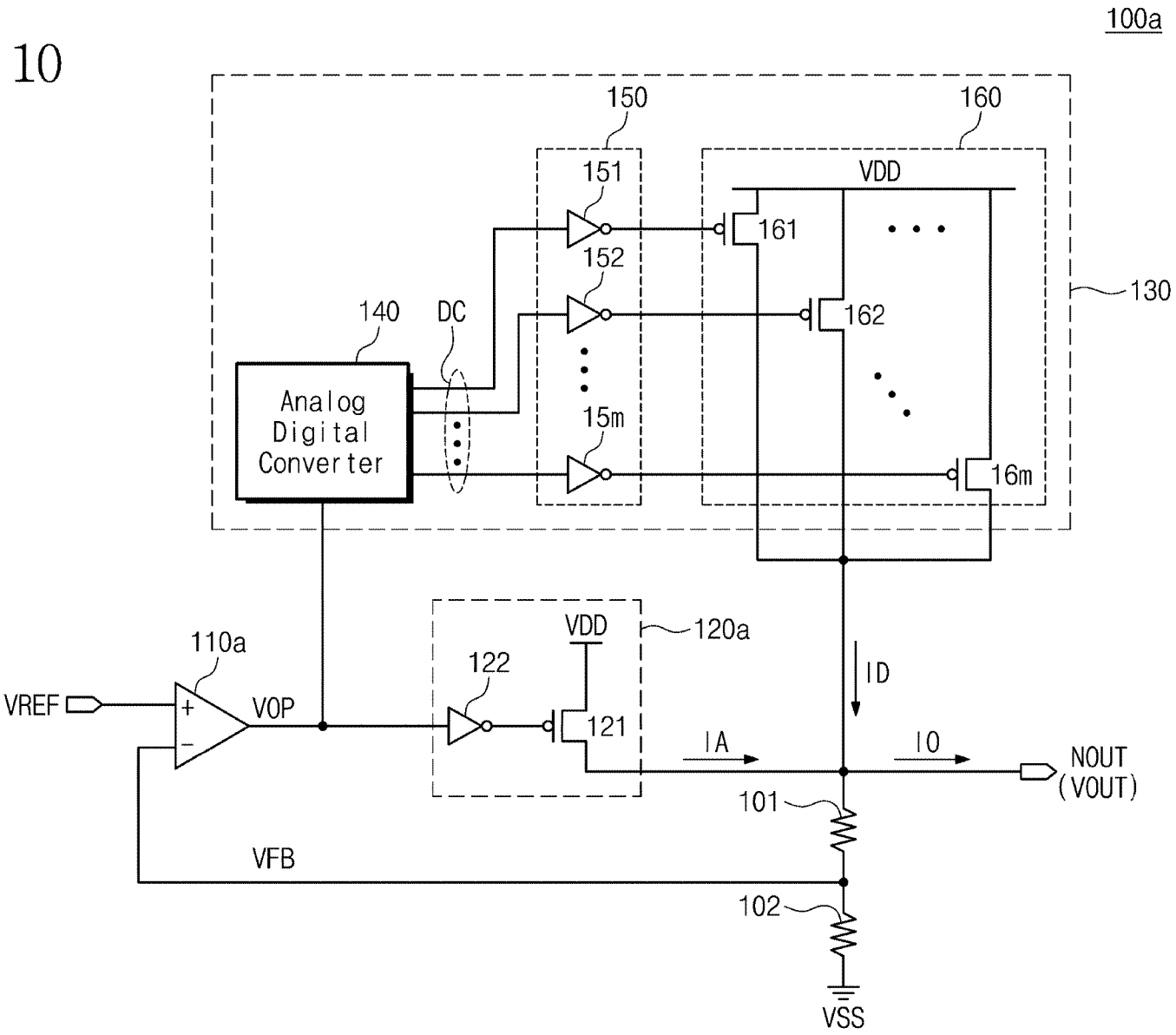
FIG. 10 illustrates another embodiment of a regulator.

FIG. 10 illustrates another embodiment of a regulator 100*as*. Referring to FIG. 10, a regulator 100*a* includes first resistor 101, second resistor 102, an amplifier 110*a*, an analog block 120*a*, and digital block 130. Configurations and operations of first resistor 101, second resistor 102, and digital block 130 may be the same as those described with reference to FIG. 1, and thus, a description thereof will not be repeated here.

Amplifier 110*a* may output only the amplification voltage, or comparison voltage, VOP. That is, amplifier 110*a* may not output the inverted amplification voltage VON. Analog block 120*a* may operate in response to the amplification voltage VOP. Compared with analog block 120 of FIG. 1, analog block 120*a* may further include an inverter 122 that inverts the amplification voltage VOP and outputs the inverted amplification voltage to second transistor 121.

Figure 11:
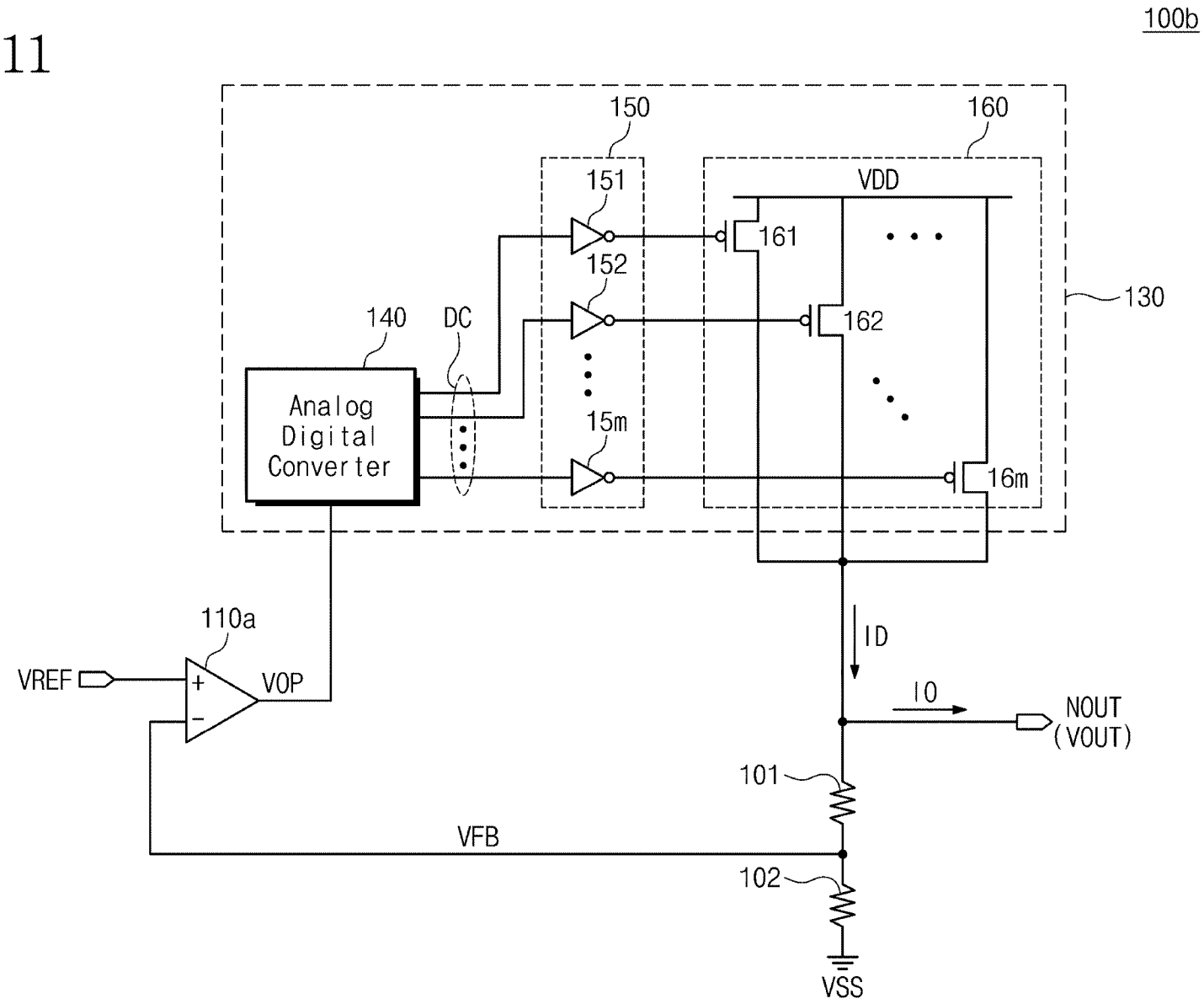
FIG. 11 illustrates another embodiment of a regulator.

FIG. 11 illustrates another embodiment of a regulator 100*b*. Referring to FIG. 11, a regulator 100*b* includes first resistor 101, second resistor 102, amplifier 110*a*, and digital block 130. Configurations and operations of first resistor 101, second resistor 102, and digital block 130 may be the same as those described with reference to FIG. 1. A configuration and an operation of amplifier 110*a* are the same as those described with reference to FIG. 10, and thus, a description thereof will not be repeated here.

Compared with regulator 100 or 100*a* of FIG. 1 or 10, analog block 120 or 120*a* may be removed from regulator 100*b*. In a robust system in which a ripple is allowed in the output voltage VOUT, digital-based regulator 100*b* having a fast response speed and a regulator occupying a reduced area may be implemented with reduced cost.

Figure 12:
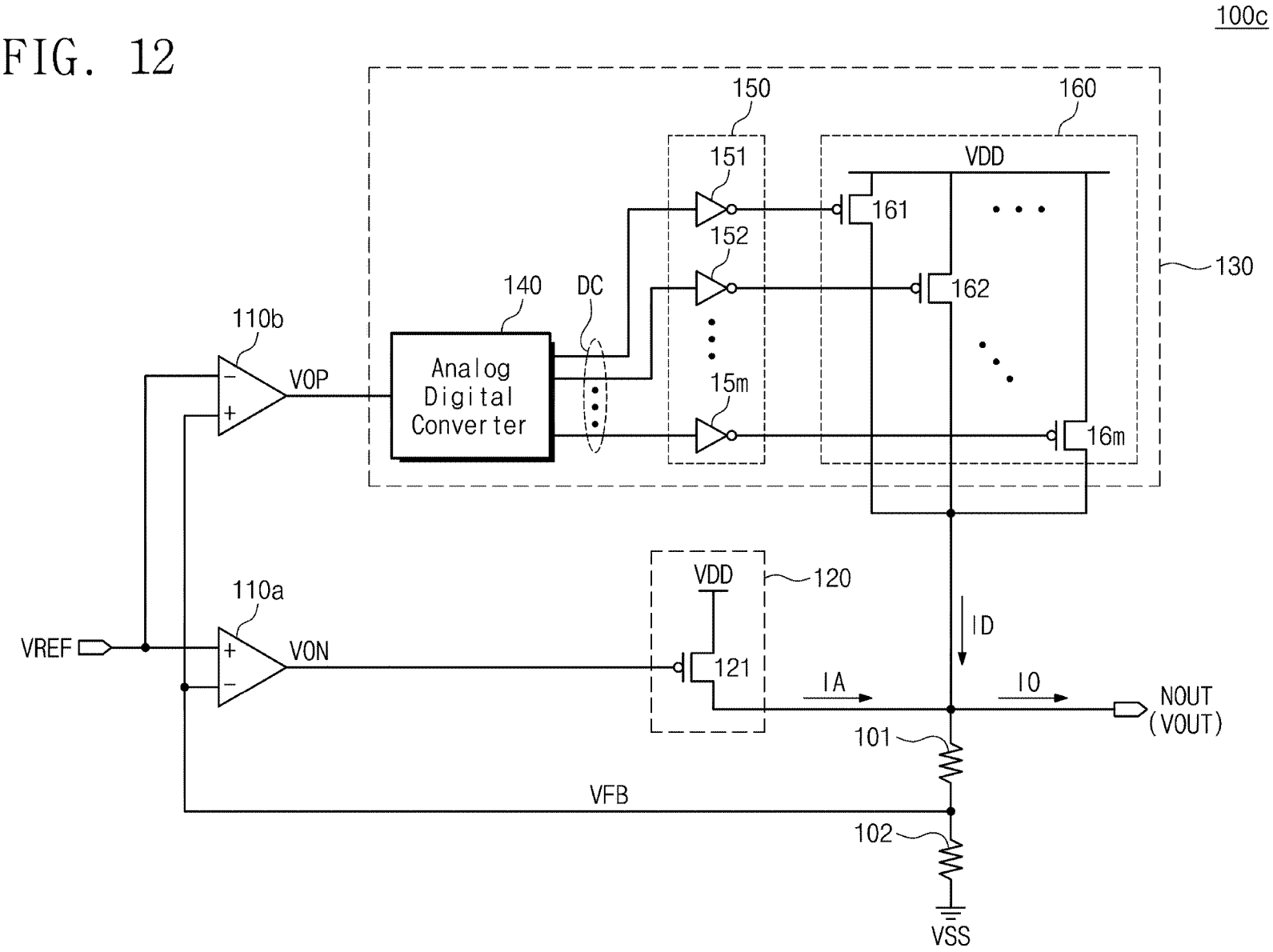
FIG. 12 illustrates an embodiment of a regulator.

FIG. 12 illustrates another embodiment of a regulator 100*c*. Referring to FIG. 12, a regulator 100*c* includes first resistor 101, second resistor 102, a first amplifier 110*a*, a second amplifier 110*b*, analog block 120, and digital block 130. Configurations and operations of first resistor 101, second resistor 102, and digital block 130 may be the same as those described with reference to FIG. 1.

First amplifier 110*a* may have a negative input to which the feedback voltage VFB is applied and a positive input to which the reference voltage VREF is applied. First amplifier 110*a* may compare the reference voltage VREF and the feedback voltage VFB and may output the amplification voltage, or comparison voltage, VOP depending on a result of the comparison.

Second amplifier 110*b* may have a positive input to which the feedback voltage VFB is applied and a negative input to which the reference voltage VREF is applied. Second amplifier 110*b* may compare the reference voltage VREF and the feedback voltage VFB and may output the inverted amplification voltage, or negative comparison voltage. VON depending on a result of the comparison.

Compared with regulator 100 described with reference to FIG. 1, regulator 100*c* of FIG. 12 may separately provide first amplifier 110*a* for digital block 130 and second amplifier 110*b* for analog block 120.

As described above, components of regulator 100, 100*a*, 100*b*, or 100*c* are above described by using the terms "first", "second", "third", and the like. However, the terms "first", "second", "third", and the like may be used to distinguish components from each other and do not limit the inventive concept. For example, the terms "first", "second", "third", and the like do not involve an order or a numerical meaning of any form.

In the above-described embodiments, components are referred to by using the term "block". The "block" may be implemented with various hardware devices, such as an integrated circuit, an application specific IC (ASCI), a field programmable gate array (FPGA), and a complex programmable logic device (CPLD), software, such as firmware and applications driven in hardware devices, or a combination of a hardware device and software. Also, a "block" may include circuits or intellectual property (IP) cores implemented with semiconductor devices.

According to embodiments of a regulator described above, coarse regulation is performed based on digital control, and fine regulation is performed based on analog control. Accordingly, a regulator having a reduced size and an improved response speed is provided, and an operating method of the regulator is also provided.

While the inventive concept has been described with reference to exemplary embodiments thereof, it will be apparent to those of ordinary skill in the art that various changes and modifications may be made thereto without departing from the spirit and scope of the inventive concept as set forth in the following claims.

What is claimed is:

1. A regulator, comprising:

a first resistor and a second resistor connected in series between a ground node and an output node;

an analog amplifier configured to compare a reference voltage to a feedback voltage between the first resistor and the second resistor, to amplify a difference between the reference voltage and the feedback voltage, to output an analog amplification voltage having a magnitude which represents the difference between the reference voltage and the feedback voltage, and to output an analog inverted amplification voltage being an inverted signal of the analog amplification voltage;

an analog-to-digital converter configured to convert the analog amplification voltage to a digital code, the digital code including at least two bits, wherein the at least two bits indicate the magnitude;

a plurality of first transistors connected between a power node supplied with a power supply voltage and the output node and which are configured to adjust a digital current being supplied to the output node in response to the digital code; and an analog block configured to supply an analog current to the output node in response to the analog inverted amplification voltage, wherein the regulator is configured to output an output current to a load, wherein the output current is a sum of the digital current output by the plurality of transistors and the analog current output by the analog block.

2. The regulator of claim 1, wherein the analog-to-digital converter includes a flash analog-to-digital converter that converts the analog amplification voltage to the digital code at one time.

3. The regulator of claim 1, wherein the analog amplification voltage varies with the difference between the reference voltage and the feedback voltage, and wherein the analog-to-digital converter adjusts the digital code as the amplification voltage varies.

4. The regulator of claim 1, wherein, when an output voltage of the output node is less than a target voltage, the analog-to-digital converter adjusts the digital code such that a number of turned-on transistors among the plurality of the first transistors increases until the output voltage of the output node reaches the target voltage.

5. The regulator of claim 4, wherein, when an output voltage of the output node is greater than a target voltage, the analog-to-digital converter adjusts the digital code such that the number of the turned-on transistors among the plurality of the first transistors decreases until the output voltage of the output node reaches the target voltage.

6. The regulator of claim 1, wherein the analog block includes a second transistor that is connected between the output node and the power node and operates in response to the analog inverted amplification voltage to output the analog current.

7. The regulator of claim 6, wherein a size of the second transistor is within 10% of a size of each of the first transistors.

8. The regulator of claim 1, wherein the first transistors have a same size as each other.

9. The regulator of claim 1, further comprising:

buffers connected between the analog-to-digital converter and the first transistors, respectively.

10. The regulator of claim 1, wherein the digital code includes "N" bits (N being a positive integer), and wherein the analog-to-digital converter includes:

resistors configured to divide the power supply voltage of the power node;

(N−1) comparators configured to generate (N−1) bits by comparing the amplification voltage with (N−1) corresponding voltages between the resistors; and an encoder configured to convert the (N−1) bits to the "N" bits.

11. A regulator, comprising:

a first resistor and a second resistor connected between a ground node and an output node;

an amplifier configured to compare a reference voltage to a feedback voltage between the first resistor and the second resistor, to amplify a difference between the reference voltage and the feedback voltage, to output an analog amplification voltage having a magnitude representing the difference between the reference voltage and the feedback voltage, and to output an analog inverted amplification voltage being an inverted signal of the analog amplification voltage;

a digital block including a-an analog-to-digital converter configured to receive the analog amplification voltage and in response thereto to discretely adjust a digital current and supply the digital current to the output node depending on the analog amplification voltage; and an analog block configured to continuously adjust an analog current and supply the analog current to the output node depending on the analog inverted amplification voltage, wherein the regulator is configured to output an output current to a load, wherein the output current is a sum of the digital current output by the digital block and the analog current output by the analog block.

12. The regulator of claim 11, wherein the digital block includes:

a plurality of first transistors connected between a power node supplied with a power supply voltage and the output node and configured to discretely adjust the digital output current in response to a digital code output by the analog-to-digital converter.

13. The regulator of claim 11, wherein the analog block includes:

a second transistor connected between a power node supplied with a power supply voltage and the output node and configured to adjust the analog output current depending on the analog inverted amplification voltage.

14. The regulator of claim 11, wherein the digital block performs coarse regulation of an output voltage of the output node in voltage steps, and the analog block performs fine regulation of the output voltage of the output node between the voltage steps.

15. The regulator of claim 11, wherein an adjustment unit in which the digital block adjusts the digital current is within 10% of a maximum adjustment range in which the analog block adjusts the analog current.

16. A method of operating a regulator, the method comprising:

dividing an output voltage of an output node to generate a feedback voltage;

amplifying a difference between the feedback voltage and a reference voltage to generate an analog amplification voltage having a magnitude which represents the difference between the reference voltage and the feedback voltage, and an analog inverted amplification voltage being an inverted signal of the analog amplification voltage;

converting the analog amplification voltage to a digital codeword including at least two bits, wherein the at least two bits indicate the magnitude;

supplying a digital current to the output node, depending on the digital codeword, to perform coarse regulation of the output voltage;

supplying an analog current to the output node, depending on the analog inverted amplification voltage, to perform fine regulation of the output voltage; and outputting an output current from the output node to a load, wherein the output current is a sum of the digital current and the analog current.

17. The method of claim 16, wherein the supplying of the digital current to the output node depending on the analog amplification voltage to perform the coarse regulation includes discretely adjusting an amount of the digital current depending on the amplification voltage.

18. The method of claim 16, wherein the supplying of the analog current to the output node depending on the analog inverted amplification voltage to perform the fine regulation includes continuously adjusting an amount of the analog current depending on the analog inverted amplification voltage.

19. The method of claim 16, wherein an amount of the analog current is less than an amount of the digital current.

* * * * *